United States Patent [19]

Ando et al.

[11] Patent Number: 4,692,043

[45] Date of Patent: Sep. 8, 1987

[54] WIRE DOT-PRINTING HEAD

[75] Inventors: Hirokazu Ando; Kazumasa Fukushima; Yasuo Ohmori; Tatsuya Koyama, all of Tokyo, Japan

[73] Assignee: Oki Electric Industry Co., Ltd., Tokyo, Japan

[21] Appl. No.: 822,587

[22] Filed: Jan. 15, 1986

[30] Foreign Application Priority Data

Jan. 16, 1985 [JP] Japan ..... 60-2826

[51] Int. Cl.[4] ..... B41J 3/12

[52] U.S. Cl. ..... 400/124; 101/93.05; 335/274

[58] Field of Search ..... 400/121, 124; 101/93.04, 93.05; 335/273, 274

[56] References Cited

U.S. PATENT DOCUMENTS

| | | | |
|---|---|---|---|
| 3,672,482 | 6/1972 | Brumbaugh | 400/124 |
| 4,225,250 | 9/1980 | Wagner et al. | 400/124 |
| 4,368,353 | 1/1983 | Ando | 101/93.04 X |
| 4,411,538 | 10/1983 | Asano | 400/124 |
| 4,433,926 | 2/1984 | Isobe | 400/124 |
| 4,449,836 | 5/1984 | Yamada | 400/124 |

*Primary Examiner*—Paul T. Sewell

*Attorney, Agent, or Firm*—Wenderoth, Lind & Ponack

[57] ABSTRACT

A wire dot-printing head has an armature, a printing wire fixedly mounted on a tip end of the armature, a leaf spring fixedly mounted in one end thereof on a rear end of the armature and fixed in the other end, a spring branch part provided on the leaf spring in the vicinity of the fixed end of the leaf spring, and an adjusting screw adjustable from the outside to be brought into close contact with the spring branch part for deflecting the leaf spring for thereby adjusting a deflection of the leaf spring and thereby an impact force of the printing wire.

6 Claims, 8 Drawing Figures

Fig. 3
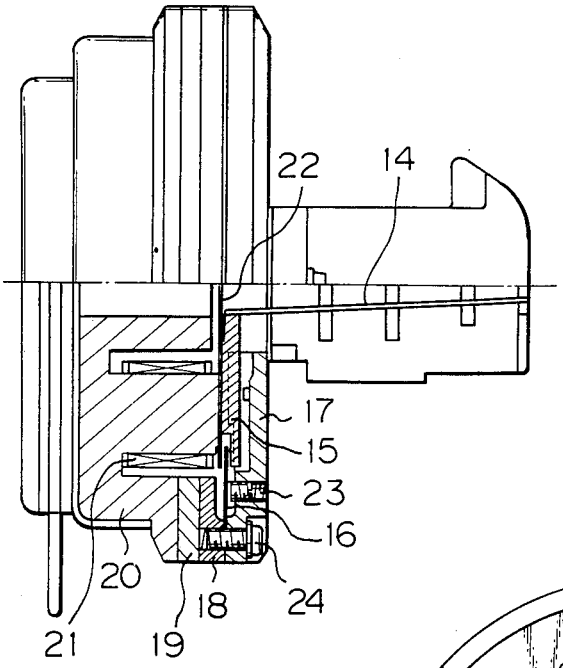
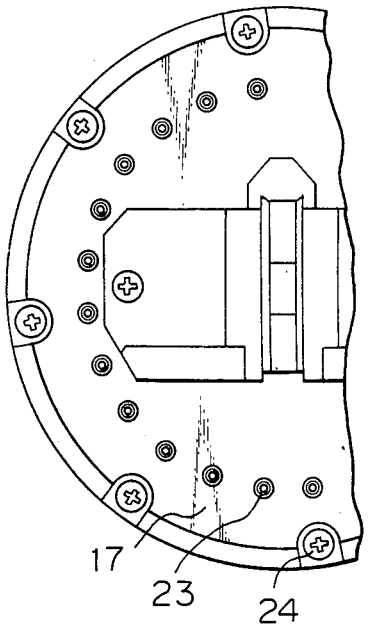
Fig. 4

WIRE DOT-PRINTING HEAD

BACKGROUND OF THE INVENTION

1. Field of the Invention

The present invention relates to a structure of a wire dot-printing head.

2. Description of the Prior Art

A wire dot-printing head is known of such a type that an elastic printing hammer is attracted by the magnetic force of a permanent magnet in non-printing operation while it is, in printing operation, released by cancelling out the magnetic force. This is disclosed, for example, in U.S. Pat. No. 4,225,250 (SEGMENTED-RING MAGNET PRINT HEAD). Japanese Utility Model Laid-Open Publication No. 58-151052 also discloses this wire dot-printing head. The latter will be described with reference to the accompanying drawings.

Referring to FIGS. 1 and 2, each showing a portion of a printing head, with a coil 7 not conducted, magnetic flux of a permanent magnet 1 passes successfully through a core 2, an armature 3, an armature yoke 4, a spacer yoke 5 and a yoke 6. The core 2 and the armature 3 are magnetically attracted to each other, whereby a leaf spring 8 is deflected and deformed.

With the coil 7 conducting current in this state, magnetic force from the coil 7 cancels out the magnetic force of the permanent magnet 1 in a gap between the armature 3 and the core 2, and thereby the armature 3 is released from the core 2. Hereupon, deformation energy stored in the leaf spring 8 is released, and the armature 3 fixedly mounted on the end of the leaf spring 8 is rotated clockwise whereby a printing wire fixed on the armature jumps out.

Mounting error upon mounting the leaf spring 8 on the armature 3 is inevitable. Thereupon, deflection of the leaf spring 8 is scattered within the printing head due to the error, whereby impact force of each printing wire is also scattered and prevents high quality and high speed printing to be effected. The auxiliary leaf spring 10 and the adjusting screw 11 serve to adjust a deflection of the leaf spring 8 to reduce the scatter of the impact force.

In addition, an auxiliary coil spring 12 and an adjusting screw 13 shown in FIG. 2 serve the same function as the auxiliary leaf spring 10 and the adjusting screw 11 shown in FIG. 1, respectively.

However, this prior printing head, even if adjusted, suffers from problems as follows.

(1) Even if the printing head is adjusted by the auxiliary leaf spring 10 and the adjusting screw 11 as shown in FIG. 1, the armature 3, as it rotates on a corner 2*a* of the core 2, slides in contact with a contact part 3*a* of the leaf spring 10. Therefore, with increased friction therebetween, the operating characteristics become unstable, while with increased wear therebetween the impact force is reduced and thereby the service life of the printing head is shortened.

(2) Even if the printing head is adjusted by the auxiliary coil spring 12 and the adjusting screw 13 as shown in FIG. 2, the operating characteristics also become unstable as in the case of the prior printing head shown in FIG. 1, and thereby the service life is likewise deteriorated.

SUMMARY OF THE INVENTION

It is an object of the present invention to facilitate the adjustment of deflection of a leaf spring.

Another object of the present invention is to reduce the affect of friction between an armature and a contact part of a leaf spring of a printing head for thereby stabilizing the operating characteristics, and thus improve the service life and the operating speed of the printing head.

With a wire dot-printing head according to the present invention, a spring branch part of a leaf spring is deflected by screwing an adjusting screw into an armature yoke, whereby deflection of the spring is changed to adjust it.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 3 is a sectional view showing a first embodiment of a wire dot-printing head according to the present invention, FIG. 4 is a plan view illustrating a portion of the printing head.

DESCRIPTION OF THE PREFERRED EMBODIMENT

Figure 1:
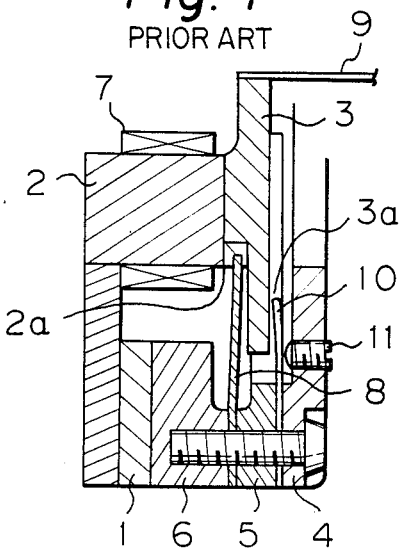
Fig. 1 PRIOR ART
FIG. 1 is a sectional view of a portion of a first prior wire dot-printing head.
Figure 2:
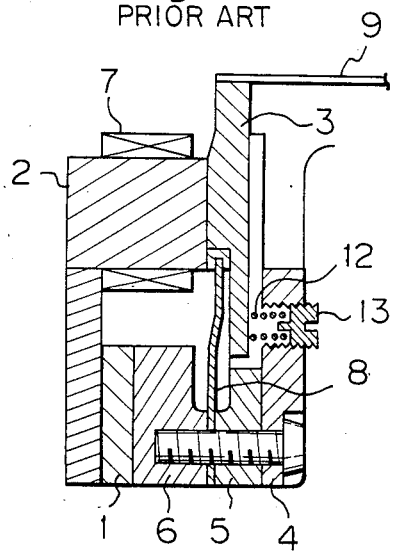
Fig. 2 PRIOR ART
FIG. 2 is a sectional view of a portion of a second prior wire dot-printing head.

An embodiment of a wire dot-printing head according to the present invention will be described with reference to FIGS. 3 and 4. Reference numeral 14 designates a printing wire, reference numeral 15 designates an armature, reference numeral 16 designates a leaf spring, reference numeral designates an armature yoke, reference numeral 18 designates a yoke, reference numeral 19 designates a permanent magnet, reference numeral 20 designates a core, reference numeral 21 designates a coil, reference numeral 22 designates a residual sheet, reference numeral 23 designates an adjusting screw and reference numeral designates a mounting screw. In a non-conduction state of the coil 21, magnetic flux of the permanent magnet 19 passes successively through the core 20, armature 15, armature yoke 17 and yoke 18. A magnetic attraction force is then produced between the core 20 and the armature 15, and thereby the leaf spring 16 is slightly resiliently deformed into an S form.

With the coil 21 conducting in this state, magnetic force produced through the coil 21 cancels out the magnetic force of the permanent magnet 19 between the core 20 and the armature 15 whereby the armature 15 is released from the coil 20. Deformation energy stored in the leaf spring 16 is released, the armature 15 fixedly mounted on one end of the leaf spring 16 is rotated and thereby the printing wire 14 fixed on the armature 15 is subjected to a printing movement.

One fixed end of the leaf spring 16 is fixedly mounted on the armature yoke 17 by laser welding, etc., and the thickness of the welded portion is thinner than that of other portions so as not to obscure assembling the device even if any burr is produced upon welding.

Figure 5:
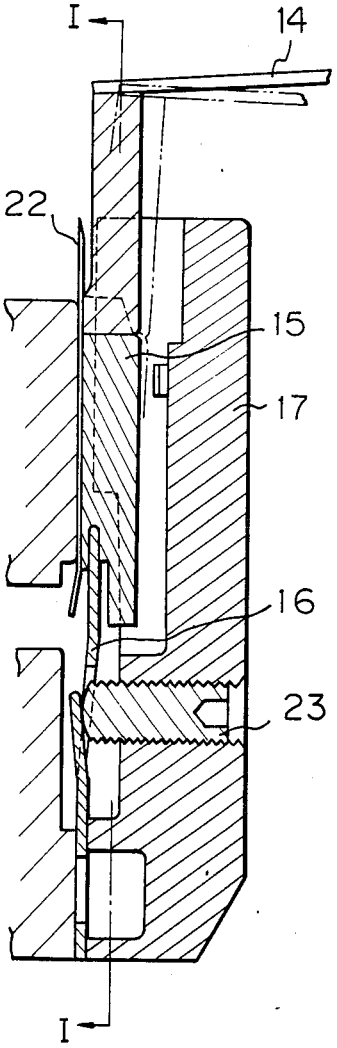
FIG. 5 is a sectional view as adjusted deflection of a leaf spring.
Figure 6:
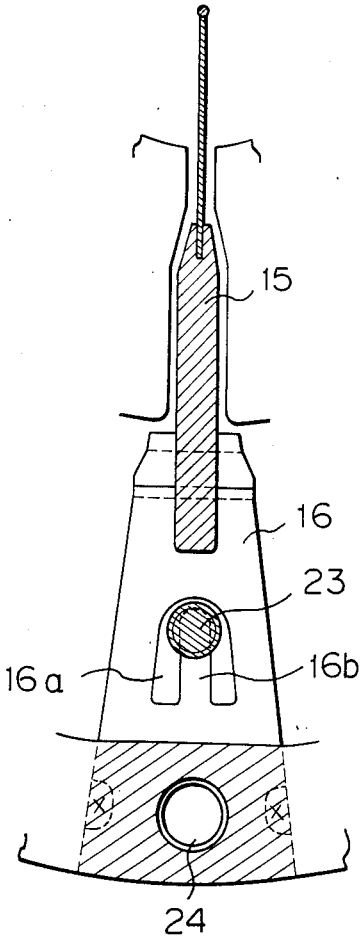
FIG. 6 is a sectional view along a line VI—VI of FIG. 5.

The deformation energy stored in the leaf spring 16, i.e., the amount of deflection the leaf spring 16, may be adjusted by screwing the adjusting screw 23. The adjusting method will be described with reference to FIGS. 5 and 6.

As shown in the figures, the numeral 16 designates a leaf spring, in which a substantially U-shaped slit 16*a* is made to establish a tongue-shaped spring branch part 16*b*.

With the branch part 16*b* deflected by screwing the adjusting screw 23 threaded through the armature yoke 17, the deflection of the leaf spring 16 can be adjusted so as to increase it.

Figure 7:
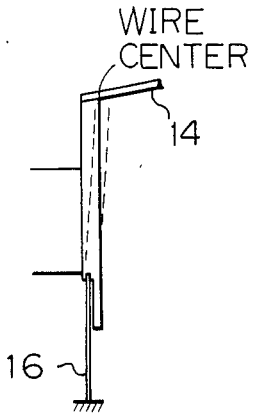
FIG. 7 is a side view showing a portion of the printing head for illustrating spring force.
Figure 8:
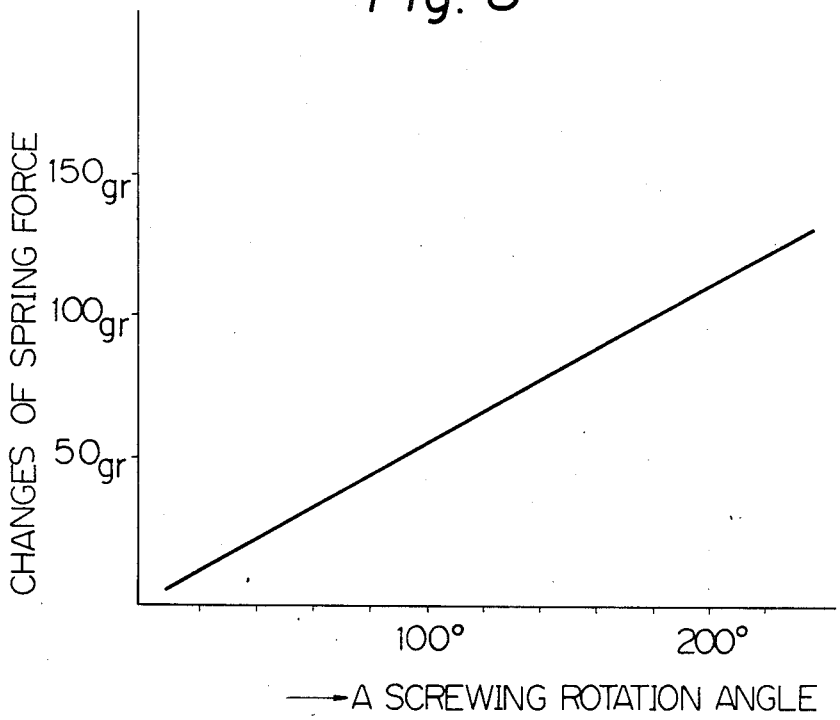
FIG. 8 is a graph showing a relationship between a screwing rotation angle and changes of spring force at a wire center.

Referring now to FIG. 8, a relationship is given between a screwing rotation angle of the adjusting screw and changes of spring force at a wire center as shown in FIG. 7. It has been found that the set spring force of a printing head in a multiple pin system is typically of about 250 gr. and will not vary much exceeding 100 gr. upon manufacturing it.

As shown in the figures, to change the spring force by 100 gr., the adjusting screw may be only screwed by 180°, and thus the impact force of the printing wire may be adjusted with ease because the screwed angle is easy to be adjusted.

Although a certain preferred embodiment has been shown and described, it should be understood that many changes and modifications may be made therein without departing from the scope of the appended claims.

What is claimed is:

1. A wire dot-print head, comprising:

a print wire;

a leaf spring having a U-shaped slit therein defining between opposite sides of said slit a tongue-shaped spring branch part of said spring;

an armature fixedly mounted on one end thereof to one end of said leaf spring, said print wire being fixedly mounted to an end of said armature opposite said one end of armature;

a leaf spring supporting member fixedly mounting thereto a fixed end of said leaf spring opposite said one end of said leaf spring, said supporting member having a threaded groove therein;

an adjusting screw threadedly engaging said threaded groove so as to be screwable therein in a direction substantially perpendicular to said tongue-shaped spring branch part into engagement with said tongue-shaped spring branch part; and drive means for selectively electrically driving said armature.

2. A wire dot-print head as in claim 1, further comprising urging means for urging said armature in a first direction to a first position against a bias of said spring, and means, including said drive means, energizable to release said armature from the urging of said urging means so that the bias of said spring moves said armature in a second direction opposite said first direction to a second position spaced from said first position.

3. A wire dot-print head as in claim 1, wherein said spring branch part if formed adjacent said fixed end of said spring.

4. A wire dot-print head as in claim 1, wherein said fixed end of said leaf spring has a portion thereof thinner than a remaining portion of said leaf spring, laser welded to said leaf spring supporting member and having no burrs thereon.

5. A wire dot-print head as in claim 2, wherein said urging means includes a core, said means for producing a first magnetic flux between said core and said armature attracting said armature toward said core, said drive means including a coil surrounding at least a portion of said core energizable to produce a second magnetic flux cancelling said first magnetic flux between said core and said armature.

6. A wire dot-print head as in claim 5, wherein said means for producing a first magnetic flux includes a permanent magnet between said core and said armature.

* * * * *